US010893734B1

(12) United States Patent
Bell et al.

(10) Patent No.: US 10,893,734 B1
(45) Date of Patent: Jan. 19, 2021

(54) CUT RESISTANT AND HIGHLY TRANSLUCENT TOTE

(71) Applicant: Armored Outdoor Gear Inc., Flagstaff, AZ (US)

(72) Inventors: James Martin Bell, Flagstaff, AZ (US); Thomas Anthony Monroe, Jr., Flagstaff, AZ (US)

(73) Assignee: Armored Outdoor Gear Inc., Flagstaff, AZ (US)

( * ) Notice: Subject to any disclaimer, the term of this patent is extended or adjusted under 35 U.S.C. 154(b) by 303 days.

(21) Appl. No.: 16/027,134

(22) Filed: Jul. 3, 2018

Related U.S. Application Data

(60) Provisional application No. 62/528,525, filed on Jul. 4, 2017.

(51) Int. Cl.

| | |
|---|---|
| ***A45C 13/18*** | (2006.01) |
| ***A45C 3/06*** | (2006.01) |
| ***A45C 3/00*** | (2006.01) |
| ***B65D 6/08*** | (2006.01) |

(52) U.S. Cl.
CPC ..... *A45C 13/185* (2013.01); *A45C 3/001* (2013.01); *A45C 3/06* (2013.01); *B65D 7/14* (2013.01); *B65D 7/20* (2013.01); *A45C 2003/002* (2013.01); *A45C 2200/10* (2013.01)

(58) Field of Classification Search
CPC ... A45C 13/185; A45C 2200/10; A45C 3/001; A45C 3/06; A45C 2003/002; B65D 7/14; B65D 7/20
USPC ..... 383/117; 220/493
See application file for complete search history.

(56) References Cited

U.S. PATENT DOCUMENTS

| | | | | |
|---|---|---|---|---|
| 1,367,207 | A * | 2/1921 | Rowan | A45C 13/04 150/124 |
| 1,368,082 | A * | 2/1921 | Wiener | A45C 3/06 150/116 |
| 1,814,378 | A | 3/1928 | Gilbertson et al. | |
| 1,915,196 | A | 3/1931 | McGuire | |
| 4,979,833 | A | 12/1990 | Cook | |
| 5,118,201 | A | 6/1992 | Cook | |
| 6,244,081 | B1 | 6/2001 | Schlipper | |
| 6,684,404 | B2 | 2/2004 | Bachner | |
| 7,069,753 | B2 | 7/2006 | Schlipper | |

(Continued)

FOREIGN PATENT DOCUMENTS

| | | |
|---|---|---|
| GB | 2359012 B | 7/2003 |
| WO | 2009036657 A1 | 3/2009 |

*Primary Examiner* — Fenn C Mathew
*Assistant Examiner* — Jennifer Castriotta
(74) *Attorney, Agent, or Firm* — Invention To Patent Services; Alex Hobson

(57) ABSTRACT

A cut resistant and highly translucent tote utilizes a multi-layer knitted metal fabric having a knitted metal outside layer and a knitted metal inside layer. These two knitted layers may be independent in a portion of the tote, such as in a clear-view portion of the tote, configured to allow clear visibility of items retained in the tote. The independent layers of knitted fabric are highly cut resistant, as they can flex in multiple direction and also move and slide with respect to each other. The tote may have a gusseted base with a base-side sleeve extending at the intersection of the base and sides to allow the tote to be free standing. An opening in the top of the tote may have a closure feature, such as hook-and-loop fastener material.

20 Claims, 12 Drawing Sheets

(56) References Cited

U.S. PATENT DOCUMENTS

| | | | | |
|---|---|---|---|---|
| 7,913,839 | B2 | 3/2011 | Fawcett et al. | |
| 9,161,596 | B2 | 10/2015 | Schlipper | |
| 9,854,890 | B2 | 2/2018 | Godshaw et al. | |
| 9,932,764 | B2 | 4/2018 | Mcmurray | |
| 10,145,044 | B2 * | 12/2018 | Schenk | A45C 3/00 |
| 2002/0021844 | A1 | 2/2002 | Rusert et al. | |
| 2007/0240798 | A1 | 10/2007 | Bihler | |
| 2009/0107876 | A1 * | 4/2009 | Bengtson | A61B 50/31<br>206/570 |
| 2016/0353850 | A1 | 12/2016 | Halpern | |

* cited by examiner

CUT RESISTANT AND HIGHLY TRANSLUCENT TOTE

CROSS REFERENCE TO RELATED APPLICATIONS

This application claims the benefit of U.S. Provisional patent application No. 62/528,525, filed Jul. 4, 2017.

BACKGROUND OF THE INVENTION

Field of the Invention

This application is directed to a cut resistant and highly transparent tote comprising a multiply knitted metal fabric.

Background

Many venues now require the public to carry a translucent bag or have their bags searched before entering. Transparent plastic bags and totes are available; however, they provide very little security from theft, whereby a thief can easily cut through the bag with a knife and/or razor and remove valuables that are easily seen through the translucent bag. There exists a need for a tote or bag that is highly translucent or transparent and that is cut resistant.

Many backpackers and campers take measures to keep rodents and other animals from getting to their food. In some cases, a food bag is tied up around a tree limb, but rodents can sometimes still make their way to the bag. In addition, there are no suitable tress in many hiking location, such as above tree line, in the desert and canyon hiking. Rodent deterrent enclosures are available; however, they are typically made of rigid metal enclosures that do not pack well and/or take up too much room in the pack. There exists a need for a flexible fabric tote or bag that is made of a material that prevents rodents from chewing therethrough.

SUMMARY OF THE INVENTION

The invention is directed to a cut resistant and highly transparent tote comprising a multiply knitted metal fabric. The tote of the present invention may be used as a food storage tote for backpacking and camping as the multiply knitted metal fabric prevents rodents from chewing therethrough. The flexibility of fabric layers and the two or multiply arrangement of independent layers makes the knitted metal fabric very cut and chew through resistant. Knitted fabrics are made from a relatively few number of strands and therefore have very few free ends. In addition, a knitted fabric has less contact surface area when layered on a second knitted fabric layer than typical woven materials, and this reduced friction enhances slip and cut through resistance. The tote of the present invention may be used to carry articles into venues, as the knitted metal fabric is highly translucent, having a high percentage of open area. The knitted metal fabric may have an open area of at least 50% or more, about 70% or more, about 80% or more about 90% or more, and any range between and including the percentages provided. This high open area of the knitted metal fabric allows security to easily see the contents therein. In addition, an exemplary tote of the present invention comprises a clear-view portion, or portion that comprises only the knitted metal fabric, and this clear view portion may be a substantial portion of the tote, or about 70% of the area or more, about 80% of the area or more, about 90% of the area of more and any range between and including the percentages provided. The tote allows clear visibility of contents therein and is also cut resistant, thereby preventing thieves from slicing through the tote to remove valuables retained therein. In addition, the top of the tote may comprise a closure feature that makes it difficult for a thief to open. The tote may have dimensions to meet requirements of venues. For example, the NFL requires bags or totes of no more than 12 inch by 12 inch by 6 inches and the totes of the present invention may fit within these dimensions. The tote of the present invention may have a dimension, such as length width or depth that is at least 75 mm or more about 100 mm or more, about 150 mm or more, about 200 mm or more, about 250 mm or more and any range between and including the dimensions provided. The tote may be large enough to carry items including food items, personal gear including cell phones, binoculars and the like.

An exemplary tote comprises a multiply knitted metal fabric, such as a two-ply knitted metal fabric comprising two layers of knitted metal, a knitted metal outside layer and a knitted metal inside layer. The layers of the knitted metal fabric may be independent layers, wherein the layers are not attached to each other and can independently move or slip across each other. This improves the cut through resistance, as the individual layers can slide to relieve shear. The knitted metal fabric may be an interloped knit wherein the strands are looped around each other to provide some range of motion, displacement and flexibility of the fabric. The flexible nature of the knitted metal fabric also increases cut through resistance, as it allows for displacement of shear and cutting forces. An exemplary knitted metal fabric may comprise, consist essentially of or consist of metal strands and these metal strands may be steel, such as stainless steel, nickel, aluminum, copper, titanium and the like. In some embodiments, the strands comprise a metallic coating or plating that may improve the hardness of the strand and/or improve corrosion resistance. For example, a nickel coated steel will have the benefits of the hard and low-cost steel and the corrosion resistance of nickel. The stands may be round in cross-section to further improve flexibility but may have a polygonal cross-section. In an exemplary embodiment, the strands of the metal fabric have a size of about 30 American Wire Gauge (AWG) or larger, about 29 AWG or larger, about 28 AWG or larger, about 26 AWG or larger, about 24 AWG or larger, about 22 AWG or larger, or between about 30 AWG and 22 AWG. If the strands are too large, the fabric may lose flexibility and the fabric may not slide in an effectively way to resist cutting. If the strands are too small, they may be more easily cut through. For this reason, a preferred range is about 30 AWG to about 26 AWG. The AWG number correlates to a millimeter size of wire, wherein 30 AWG is about 0.255 mm in diameter, 29 AWG is about 0.286 mm in diameter, 28 AWG is about 0.33 mm in diameter, 26 AWG is about 0.4 mm in diameter, 24 AWG is about 0.5 mm in diameter, 22 AWG is about 0.63 mm in diameter, 20 AWG is about 0.81 mm in diameter, and 18 AWG is about 1.0 mm in diameter. 0.011.

An exemplary tote is cut resistant wherein a pocket knife or utility knife will not cut through the multilayer metal fabric. A utility knife with a razor blade can be pressed down manually and drug across the multilayer metal fabric with the blade held at about 45 degrees to the metal fabric and without cutting the through the fabric or the strands of the fabric. The exemplary two-ply knitted metal fabric can withstand this test without being cut through.

An exemplary tote forms and enclosure having a top opening and a closure feature to secure the top opening in a closed position, wherein the front and back of the tote are brought together and retained along the top. A closure feature may comprise a hook-and-loop fastener, a zipper, a plurality of snaps or buttons and the like. A preferred closure is a hook-and-loop fastener or zipper that extends along the top opening of the tote. The closure feature may be configured on a top-opening sleeve that may extend around the perimeter of the top of the tote and around the end of the knitted metal fabric. The top opening sleeve may wrap over the top of the multiply metal fabric, from the inside to the outside of the tote. A top opening sleeve may cover the ends of any loose strands that extend from the top of the knitted metal fabric. In another embodiment, a closure feature may comprise a flap that extends from the one side to the opposing side of the tote, such as from the front to the back. A user may extend the flap over the opening and secure a hook-and-loop fastener configured on the flap to an opposing hook-and-loop fastener on the opposing side of the top opening sleeve.

An exemplary tote may be made from a continuous sleeve of multiply knitted metal fabric having a perimeter and length. The sleeve may be formed into a tote having a desired shape by crimping the multiply metal fabric to form an edge between sides or surfaces. An exemplary tote comprises a plurality of crimped edges that are formed in the knitted metal fabric to create a shape. For example, a knitted metal fabric may be crimped along the sides to form a side crimped edge that extends from the top opening sleeve to the base of the tote. When a tote has a single side crimped edge on the left and right side, the tote may be in the shape of an envelope with two parallel front and back sides or surfaces and crimped and folded portion extending along the sides. The crimp in an envelope type tote bends the multiply knitted metal fabric substantially 180 degrees, such that the front and back sides extend parallel to each other. A tote may have a gusseted base or bottom and have a block shape, with a front surface, back surface, left and right surfaces and a base surface. A base coupling and/or sleeve may extend around the free ends of the multiply knitted metal fabric along the base to form the enclosure. A block-shaped tote may have two side crimped edges that extend along each of the left and right sides, one along the intersection of the front surface and the side and one along the intersection of the back surface and the side. The crimped edges extending along the sides may form substantially orthogonal surfaces wherein the multiply knitted metal fabric is crimped to form substantially 90 degree bends from one surface to the other, or within about 10 degrees of 90 degrees. The woven metal fabric may hold the crimped shape as the metal is deformed beyond an elastic yield point. The distance between two side crimped edges may be the depth of the tote. Likewise, a gusseted base tote may comprise bottom crimped edges that extend along the intersection of the front surface and the base, and along the back surface and the base, as well as along the interface of each side and the base, to produce a rectangular base. A sleeve may extend along the crimped edges, or along a coupled portion of the base, wherein two free ends of the knitted metal fabric are coupled together.

An exemplary tote may comprise one or more grommets that extend through a surface, or multiple surfaces of the tote. A grommet may be used to couple a strap or rope to the tote. A grommet may extend through a sleeve portion of the tote and also through the knitted metal fabric. In an exemplary embodiment, a tote has a grommet in the top-opening sleeve and the grommet couples the front and back surfaces together. In another exemplary embodiment, a tote has two grommets configured in the top-opening sleeve and proximal the left and right sides to allow a carrying strap to be retained therein.

An exemplary tote has clear-view portion that is highly translucent, thereby making it easy to view contents within the tote. A clear-view portion may be a substantial portion of the surface area of the tote and may extend from the bottom of the top-opening sleeve to the base. A clear-view portion may extend along the front, back, and both the left and right sides of the tote, making identification of articles possible from any side of the tote.

Also described herein is a lock cable that comprises a multilayer metal fabric and preferably multiple layers of a knitted metal fabric, as this type of metal fabric is highly resistant to cut-through. The multilayer metal fabric and a fabric layer may be layered or rolled to form the lock cable extension. A lock coupler extension, such as a cut resistant cable, may be centrally located in the middle of the lock cable with the multilayer metal fabric configured around it. The multilayer metal fabric may be a jelly-roll within the lock cable which may enable free movement of each layer to resist cutting. An exemplary lock cable may have a lock element, such as a lock insertion portion and lock receiver portion coupled to the lock coupler that extends along an interior and along the length of the lock cable. The lock elements may be made of hard metal that is cut resistant. A pair of lock rings may be coupled to the lock coupler with one on a first and one on the opposing second end. The lock cable may be wrapped around an article and a pad lock may be inserted into through the two lock rings to secure the lock cable around the article. A lock cable may comprise an integral lock ring, wherein the lock cable is turned back on itself to make a loop and the extended end is coupled to the lock cable, such as by a crimp that is swaged around the extended end and lock cable extension.

Also described herein is an insect flying disc that comprises a metal fabric configured in a circular shape with a sleeve extending therearound. The central portion may be a single layer or multilayer metal fabric and may have a clear-view area that is highly translucent, as described herein. The sleeve may be a fabric sleeve that extends around the metal fabric and is secured with a stitch, for example. A resilient ring such as a spring steel ring may be configured within the sleeve and allow the insect flying disc to be folded to a smaller dimension for storage. The resilient ring will pop open the insect flying disc to the disc shape when released from restrained orientation. The insect flying disc can be thrown to capture insects in the air and may land over insects or other animals to keep them retained under the flying disc.

The insect flying disc and the tote of the present invention may be used for a variety of other purposes wherein a durable open mesh or fabric is required, such as sieving applications, beachcombing, gold panning, a chum bag for fishing bait, and the like. The open nature of the metal fabric may be well suited for such purposes. These compactable articles can be carried into remote areas for use in sieving.

The summary of the invention is provided as a general introduction to some of the embodiments of the invention and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

Figure 1:
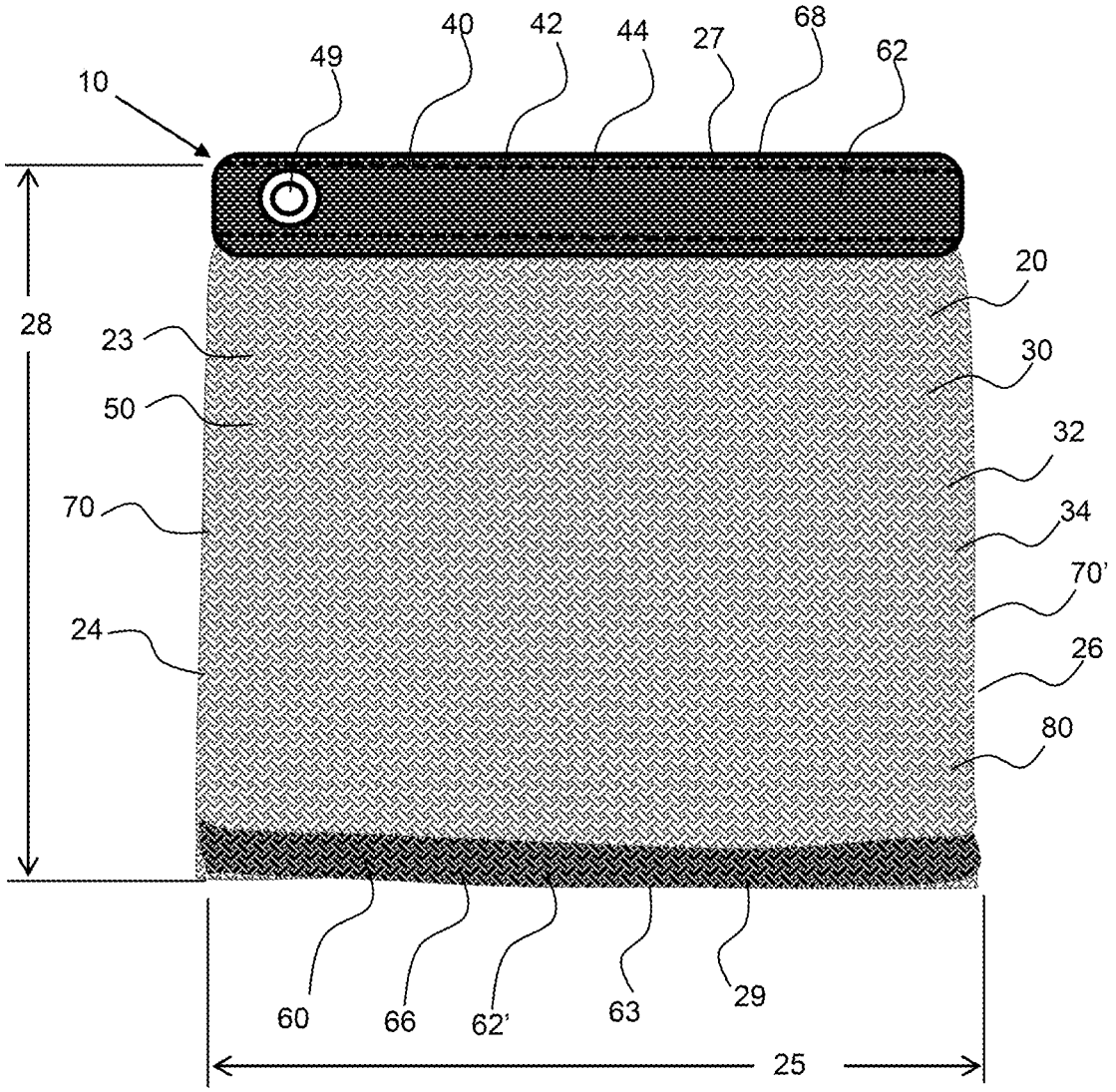
FIG. 1 shows a front view of an exemplary tote of the present invention comprising two unattached layers of knitted metal in the clear-view portion of the tote.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

DETAILED DESCRIPTION OF THE ILLUSTRATED EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

Figure 3:
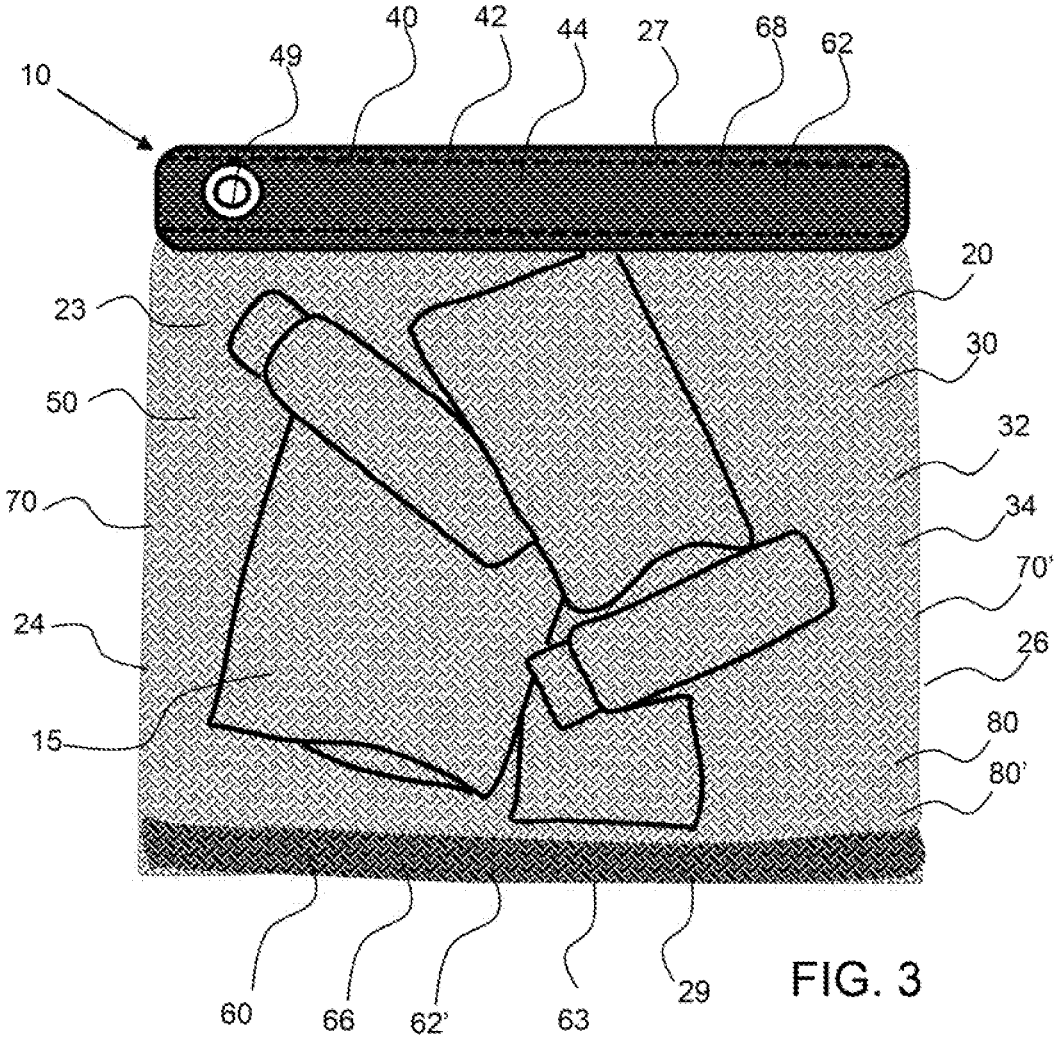
FIG. 3 shows a front view of an exemplary tote of the present invention having articles clearly visible therein.
Figure 4:
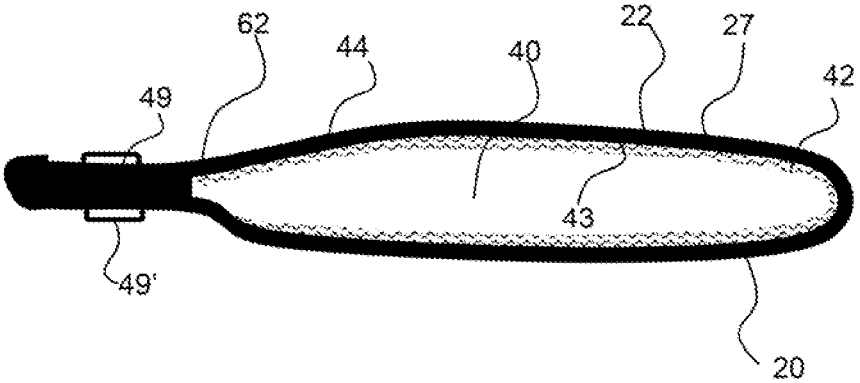
FIG. 4 shows a top view of an exemplary tote having a grommet and closure feature.

Referring now to FIGS. 1 and 4, an exemplary tote 10 comprises a multilayer knitted metal fabric 80 that is translucent having a high open area and is cut resistant. The multilayer knitted metal fabric may be a fabric sleeve 23 consisting of the multilayer knitted metal fabric in a continuous sleeve, with no seams along the length of the sleeve wherein the multilayer knitted metal fabric extends continuously around the perimeter of the sleeve. An exemplary sleeve with have free end at the top and bottom. A clear view portion 50 of the tote, or area that is highly translucent, such as from the top opening sleeve 44 to the base 29, allows article retained therein to be clearly viewed through the multi-layer metal fabric 80. A crimped edge 70, 70' extends from the top-opening sleeve 44 to the base 29 to create an envelope shaped tote with parallel front 20 and back 22 surfaces. The exemplary tote comprises a multilayer knitted fabric 80, such as a two-ply knitted fabric 30, comprising independent and unattached layers of an inside and outside layer of knitted metal fabric 32, 34, to produce a cut resistant tote having a clear-view portion 50. As shown in FIG. 3, items 15 within the tote are clearly visible.

The exemplary tote has a top opening 40 with a closure feature 42, such as hook-and-loop fastener material 43 or zipper. A top opening sleeve 44, such as a fabric 62, extends over the knitted metal fabric to encapsulate the top edge of the knitted metal fabric. A stitch 68 may extend through this fabric and the multi-layer fabric 80 to secure the two components together. A grommet 49 extends through the top opening sleeve and the knitted metal fabric to secure the front and back together, as best shown in FIG. 4. The grommet provides a means to secure a strap, clip, a karabiner or other fastener to the tote. The tote has a height 28 from the top 27 to the base 29, or bottom, and a width 25 from the first side 24 to the second side 26. Crimped edges 70 and 70' are configured between the front 20 and back 22 surfaces of the tote in the multi-layer metal fabric 80. The crimpled edges bend and sets the multilayer knitted fabric 80 substantially 180 degrees.

Figure 2:
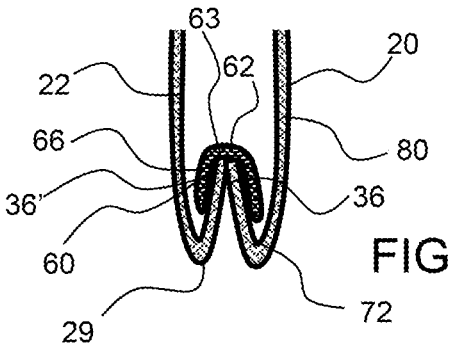
FIG. 2 shows a cross-sectional view of an exemplary base coupling, an inverted sleeve.

A base coupling 60 couples the front and back multi-layer metal fabric 80 to form the base 29, as best shown in FIG. 2. The base coupling is an inverted seam 66, wherein the multilayer fabric 80 has a base crimp 72 that folds the multilayer knitted metal fabric 80 inward toward the interior of the tote. A sleeve coupler 63, such as fabric 62 extends over the free ends 36, 36' of the multilayer fabric and is secured to each of the free ends together. This inverted seam keeps the free ends of the metal fabric pointed inward.

A clear-view portion 50 extends from the top opening sleeve 44 to the base 29 and comprises or consists of the multi-layer metal fabric 80, such as a two-ply metal fabric layer 30. The two-ply metal fabric layer 30 is made up of a knitted metal inside layer 32 and a knitted metal outside layer 34. In an exemplary embodiment, these two layers are unattached in the clear-view portion to allow independent movement to further increase cut through resistance. The open area of the clear view portion may be about 50% or more, about 70% or more, about 80% or more, about 90% or more and any range between and including the percentages provided. The clear view portion layer may be multilayer metal fabric sleeve having no seams around the perimeter.

Figure 5:
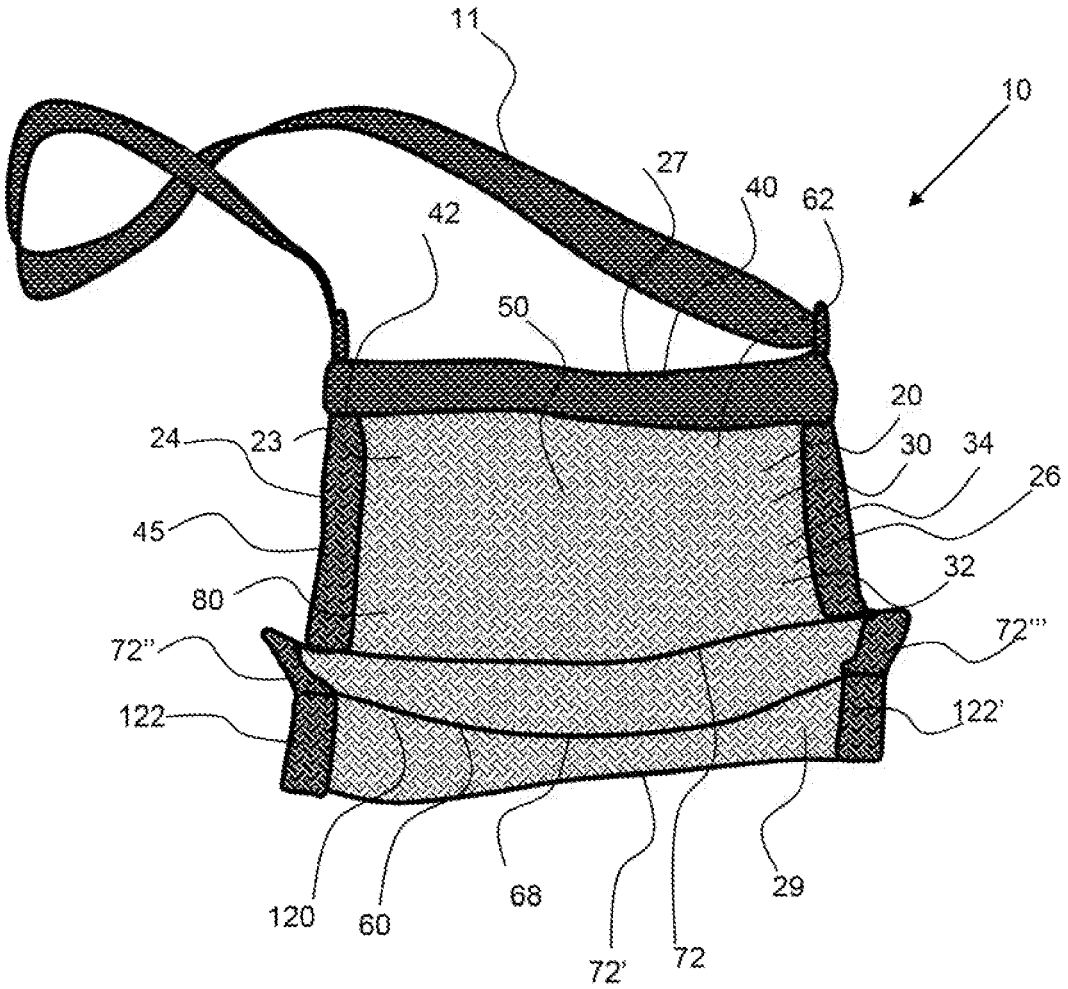
FIG. 5 shows a perspective view of an exemplary tote of the present invention having a gusseted bottom.
Figure 6:
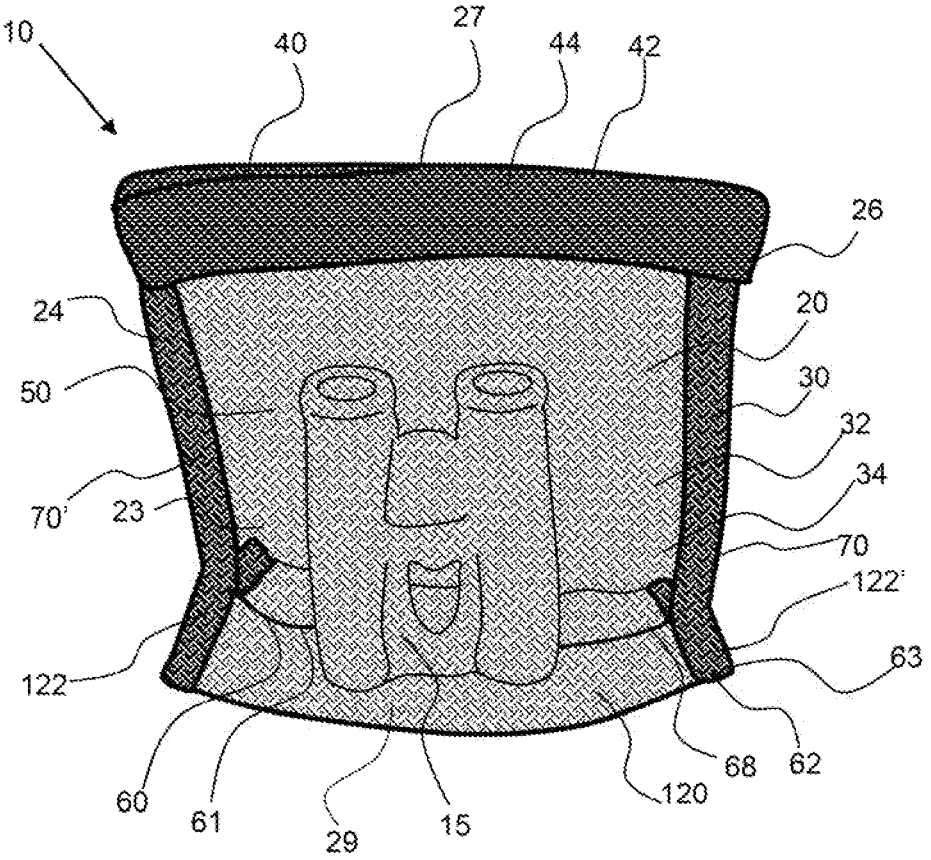
FIG. 6 shows the tote of FIG. 5 with binoculars configured therein and clearly visible through the clear-view portion of the tote.
Figure 7:
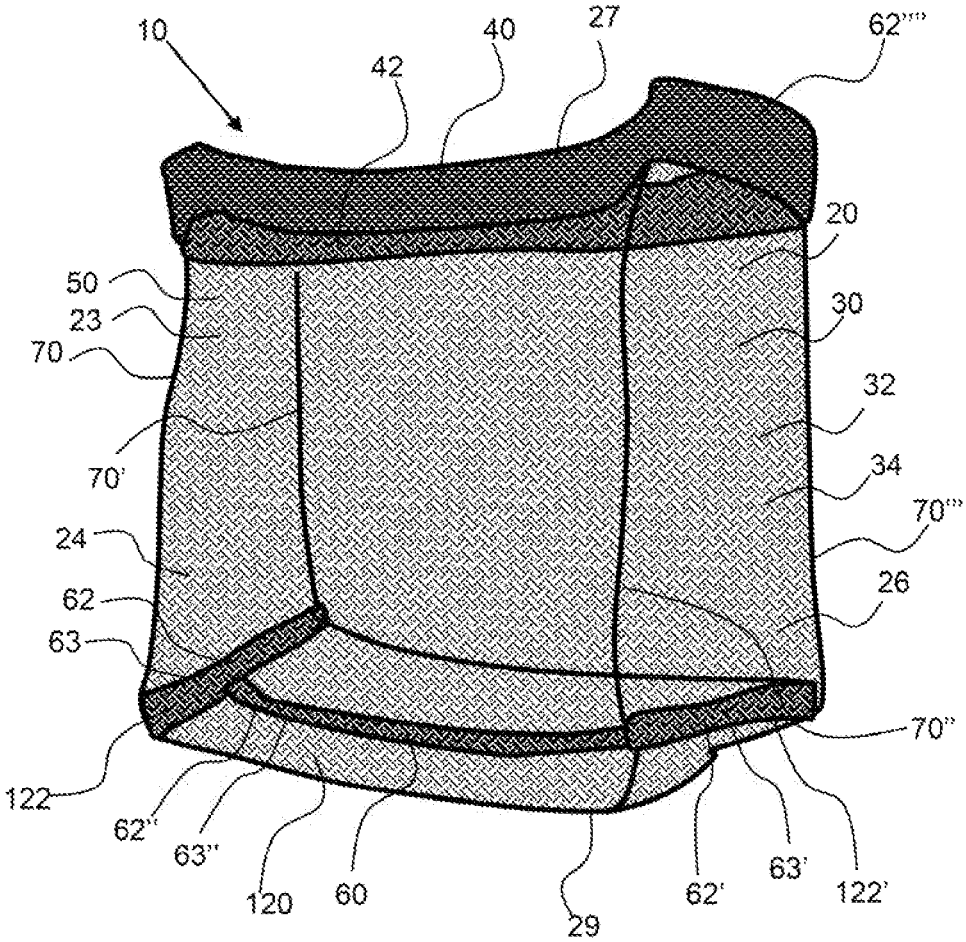
FIG. 7 shows perspective view of an exemplary tote of the present invention having a gusseted bottom.

As shown in FIGS. 5 to 7, an exemplary tote 10 is configured with a gusseted base 120, or bottom that extends horizontally to allow the tote to stand upright. The tote of the present invention may be free-standing, wherein it will stand upright on the gusseted bottom without additional support. As shown in FIG. 5, a strap 11 is coupled to the tote 10. A gusseted base may be formed by crimped base edges 72, 72' that extends across the base from the first side 24 to the second side 26, and crimped edges that extend along either side, 72", 72'". The distance between the crimped base edges extending along the front and back surfaces may define the depth of the base. A base-side sleeve 122, 122' may extend across the side of the base. The metal fabric may have a base coupling 60 that extends across the base from the first side to the second side and this coupled portion may have a sleeve coupler 63, such as fabric 62 to cover any loose metal strands and/or to couple edges of the metal fabric together, as shown in FIG. 7. As shown in FIG. 5 and FIG. 6, the base comprises a stich 68 to produce the seam in the multilayer metal fabric 80. As shown in FIGS. 5 and 6, a side sleeve 45 extends along the side of the tote and may extend around a crimped edge of the metal fabric. The tote shown in FIG. 5 and FIG. 6 has a gusseted bottom but only one crimped edge along the two vertical sides to produce an irregular shaped tote. As shown in FIG. 6, the tote is free-standing on the base 29 with an article 15, binoculars, within the interior of the tote. As shown in FIG. 7, side surfaces are formed in the tote by the two crimped side edges 70, 70' along the left side and 70", 70'" extending along the right side, and this produces a block shaped tote having front and back surfaces as well as left and right surfaces and a base surface. The surfaces described herein, may be planar surfaces connected along edges to form a block shaped enclosure. The base of the tote shown in FIG. 7, as well as the front, back, and side surface are rectangular in shape, formed by the crimped edges and sleeve couplers. As shown in FIG. 7, the clear view portion 50 of the tote is more than 75% of the surface of the tote, as calculated by taking the area of each of the sides, or surfaces. The front, back and side surfaces, as well as a majority of the base are substantially the independent multilayer knitted metal fabric. Only the sleeve couplers along the base and the top-opening sleeve are not transparent.

Figure 8:
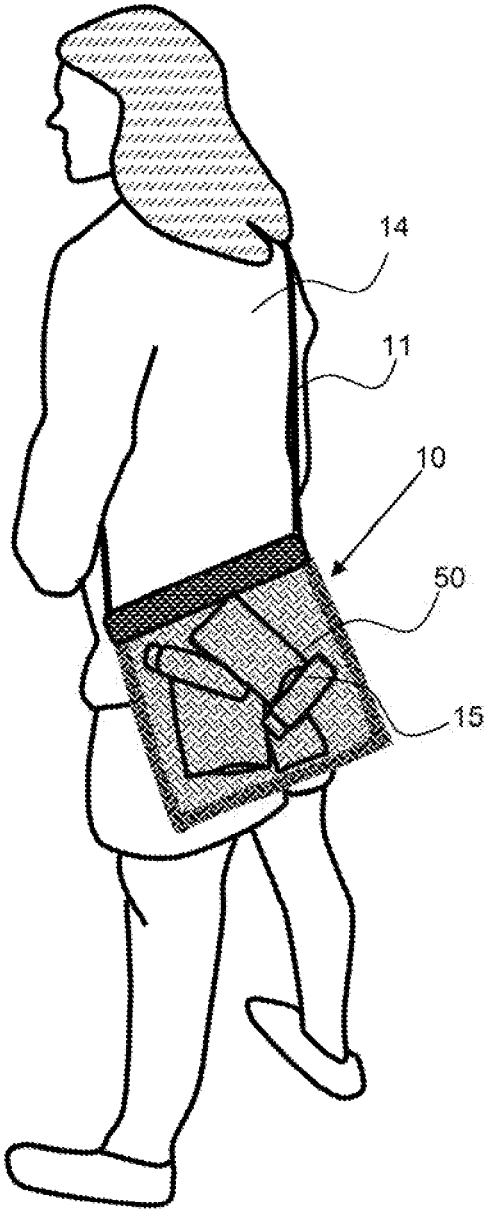
FIG. 8 shows a person carrying a tote of the present invention with contents dearly visible through the clear-view portion.

As shown in FIG. 8, a person 14 is carrying an exemplary tote 10 of the present invention by a strap 11. The exemplary tote has a clear-view portion 50 to allow inspection of items in the tote 15.

Figure 9:
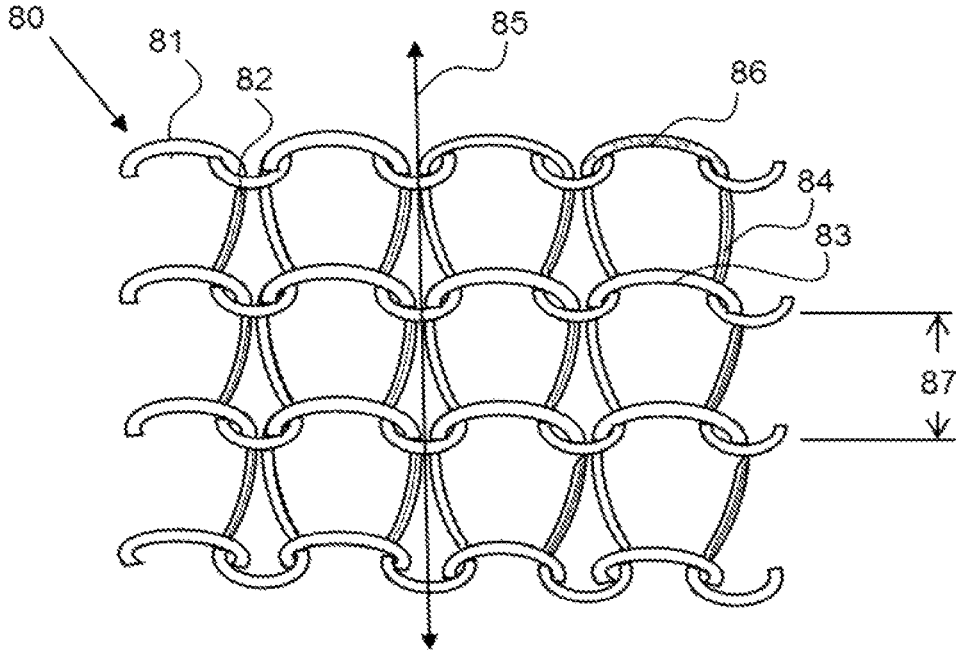
FIG. 9 shows an exemplary knitted metal having an interloping knit weave.
Figure 10:
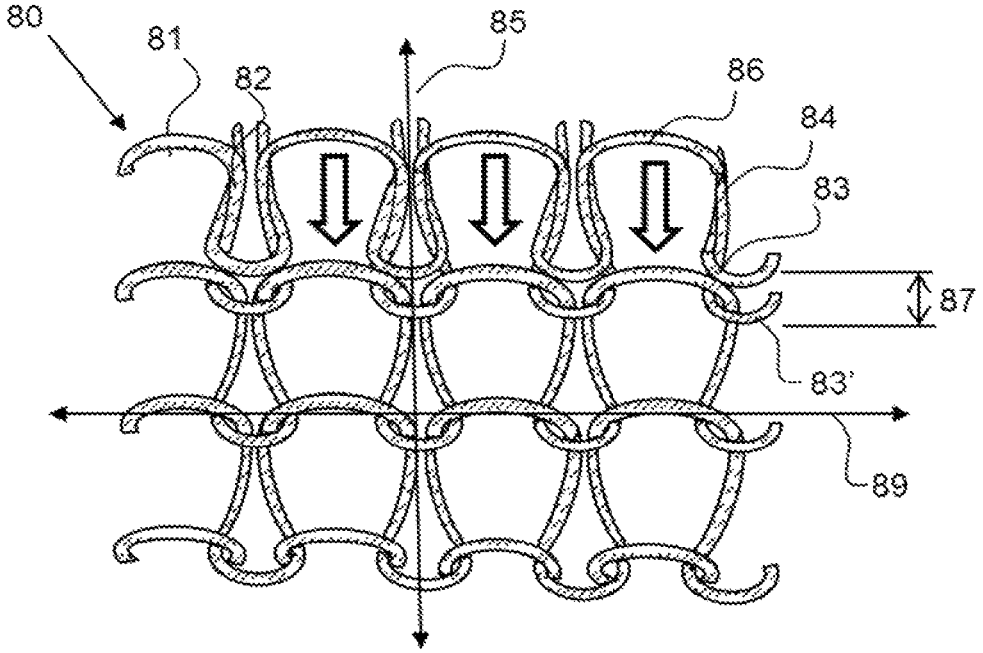
FIG. 10 shows an exemplary knitted metal having an interloping knit weave that is contracted along the loop axis.
Figure 11:
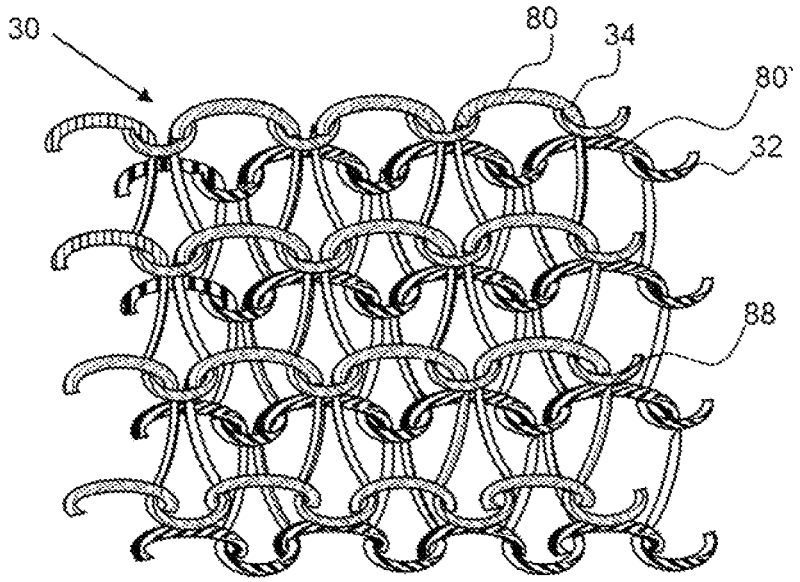
FIG. 11 shows a two-ply layer knitted metal layer, wherein each knitted metal layer has an interloping knit weave.

Referring now to FIGS. 9 to 11, an exemplary knitted metal fabric 80, has an interloping knit pattern. The knitted metal fabric comprises metal strands 81 that are coupled together by coupling loops 82. As shown the strands have a weft portion 83, or portion where they extend in the weft direction, or cross machine direction, and a warp portion 84, or portion where they extend in the warp direction, or machine direction. The coupling loops extend around two main loops 86 of the knitted fabric. The main loops are larger in dimension than the coupling loops in this exemplary knitted fabric. The machine direction distance between the coupling loops or the loop gap 87 enables movement and flexibility of the fabric in the loop axis 85, or axis of motion of the coupling loops 82. The loop gap distance when the fabric is stretched taut in the loop axis 85 may be about 2 mm or more, about 4 mm or more, about 6 mm or more, about 10 mm or more and any range between and including the values provided. As shown in FIG. 10, the coupling loops have slid in compression or toward each other over the main loops 86 to reduce the loop gap 87. This allows the fabric to be flexible in the loop axis direction, or an axis extending in the warp or machine direction. The fabric also some flexibility in the weft or cross machine direction or weft axis 89 when the coupling loops are larger with respect to the two metal strands coupled therein. As shown in FIG. 11, an exemplary two-ply knitted metal layer or fabric 30 is an independent layered fabric 88 having two independent layers of knitted metal, a knitted metal inside layer 32 and a knitted metal outside layer 34. The two layers are not attached can move independent of each other and this makes it very difficult to cut through the fabric layer. The two fabric layers can slide over each other, and the strands of each of the fabric layers can move independent of each other. Each layer is flexible and they move independently. These layers and the strands within each layer will slip and slide in response to force such as a compression force and prevent cutting.

Figure 12:
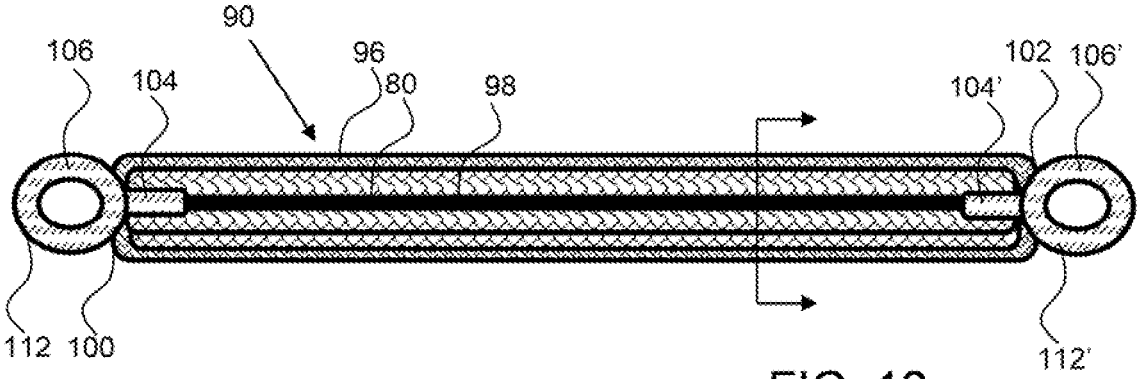
FIG. 12 shows a cross-sectional view of an exemplary lock cable comprising a knitted metal fabric coil.
Figure 13:
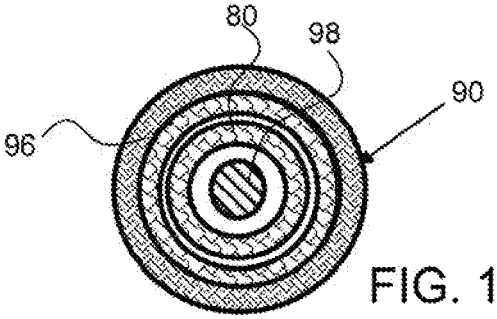
FIG. 13 shows a length cross-sectional view of an exemplary lock cable comprising a knitted metal fabric coil.
Figure 14:
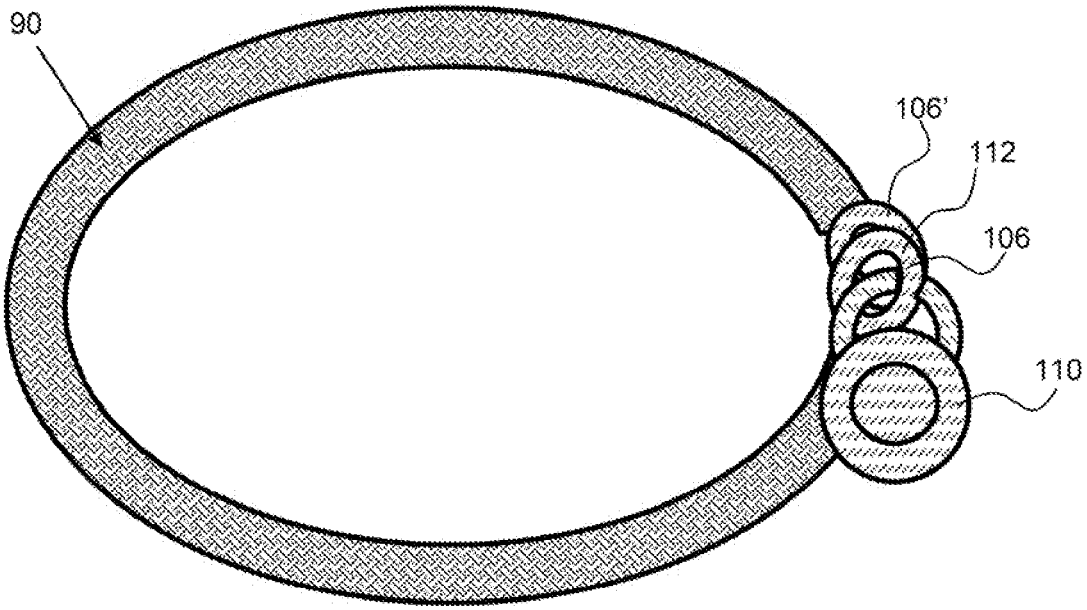
FIG. 14 shows a top view of an exemplary lock cable comprising a knitted metal fabric coil.
Figure 15:
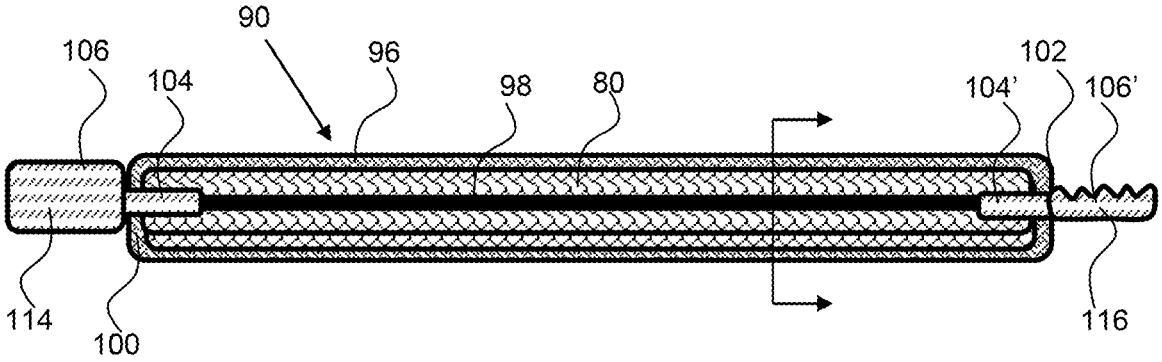
FIG. 15 shows a cross-sectional view of an exemplary lock cable comprising a knitted metal fabric coil.
Figure 16:
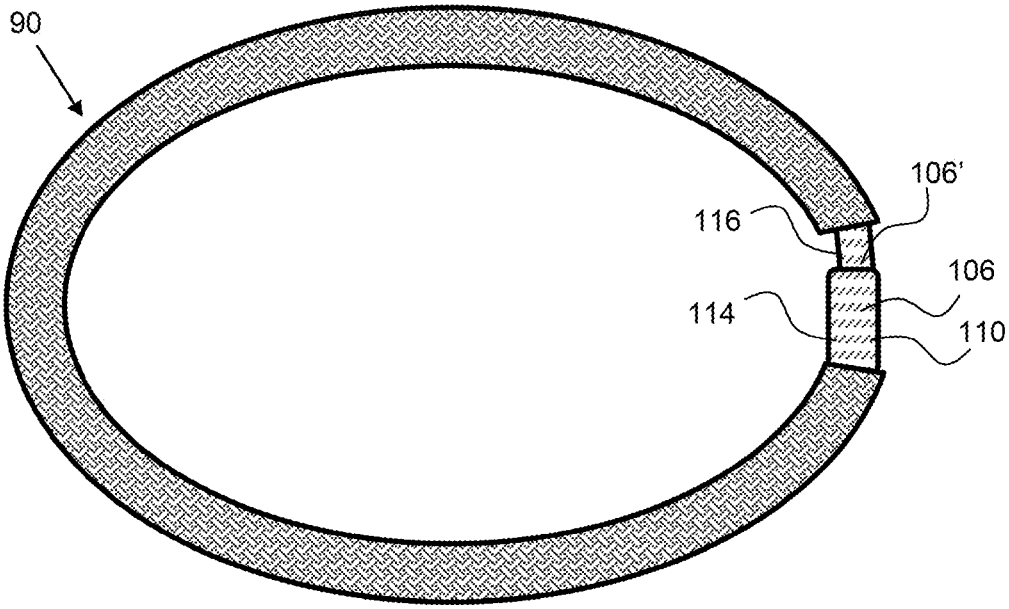
FIG. 16 shows a top view of an exemplary lock cable comprising a knitted metal fabric coil.
Figure 17:
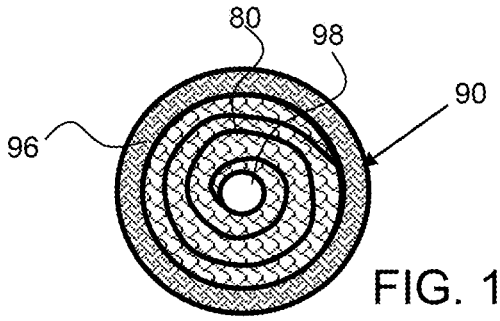
FIG. 17 shows a length cross-sectional view of an exemplary lock cable comprising a knitted metal fabric coil.
Figure 18:
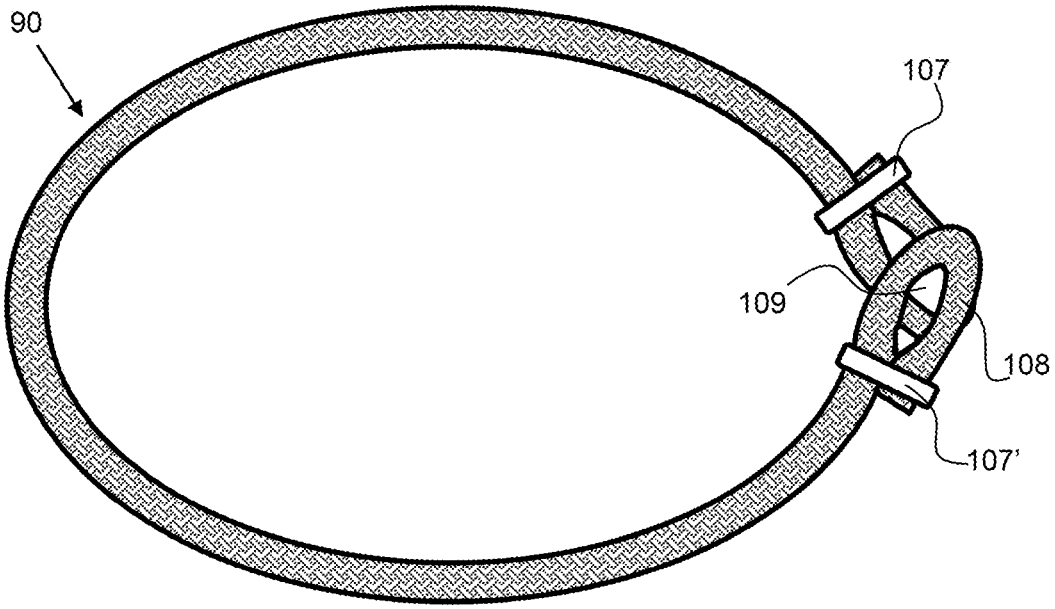
FIG. 18 shows a top view of an exemplary lock cable comprising a knitted metal fabric coil.

Referring now to FIGS. 12 to 18, an exemplary lock cable 90 comprises a multilayer metal fabric 80, such as a two-ply knitted metal layer. A fabric layer 96 extends around the metal fabric and a lock coupler extension 98 may extend along the length of the lock cable to a lock portion, such as a lock receiver portion 114, as and to a lock insertion portion 116 shown in FIG. 15. The lock coupler extension extends between lock rings 112, 112' as shown in FIG. 12. The lock coupler extension 98 may couple with a lock interior portion 104 that extends into the multilayer metal fabric to prevent disconnection or tampering with the lock coupler extension. The lock exterior portions 106, such as the lock receiver or lock rings extend out from the interior of the lock cable. The lock coupler extension may be a cable, such as a hardened metal or braided cable or other flexible and cut resistance cable. The lock cable has a length from a first end 100 to a second end 102. As shown in FIG. 14, a lock 110 may be inserted through apertures, the lock exterior portion 106, or lock rings 112, to secure the lock cable around an article. As shown in FIG. 16, the lock insertion portion 116 may be inserted into the lock receiver portion 114 to coupled the lock cable 90 around an article. As shown in FIG. 18, a lock cable 90 may comprise a looped end 108 with a crimp 107 swaged around the loop extended end of the cable to produce an aperture 109. A pad lock or other suitable lock may be configured through the aperture to secure the lock cable 90 around an article.

As shown in FIGS. 13 and 17, the lock cable may comprise a multilayer metal fabric, and preferably multiple layers of a knitted metal fabric, as this type of metal fabric is highly resistant to cut-through. As shown in FIG. 13, the multilayer metal fabric 80 and a fabric layer 96 may be layered or rolled to form the lock cable extension. A lock coupler extension 98, such as a cut resistant cable may be centrally located in the middle of the lock cable with the multilayer metal fabric configured around it. As shown in FIG. 17, the multilayer metal fabric may be a jelly-roll within the lock cable.

Figure 19:
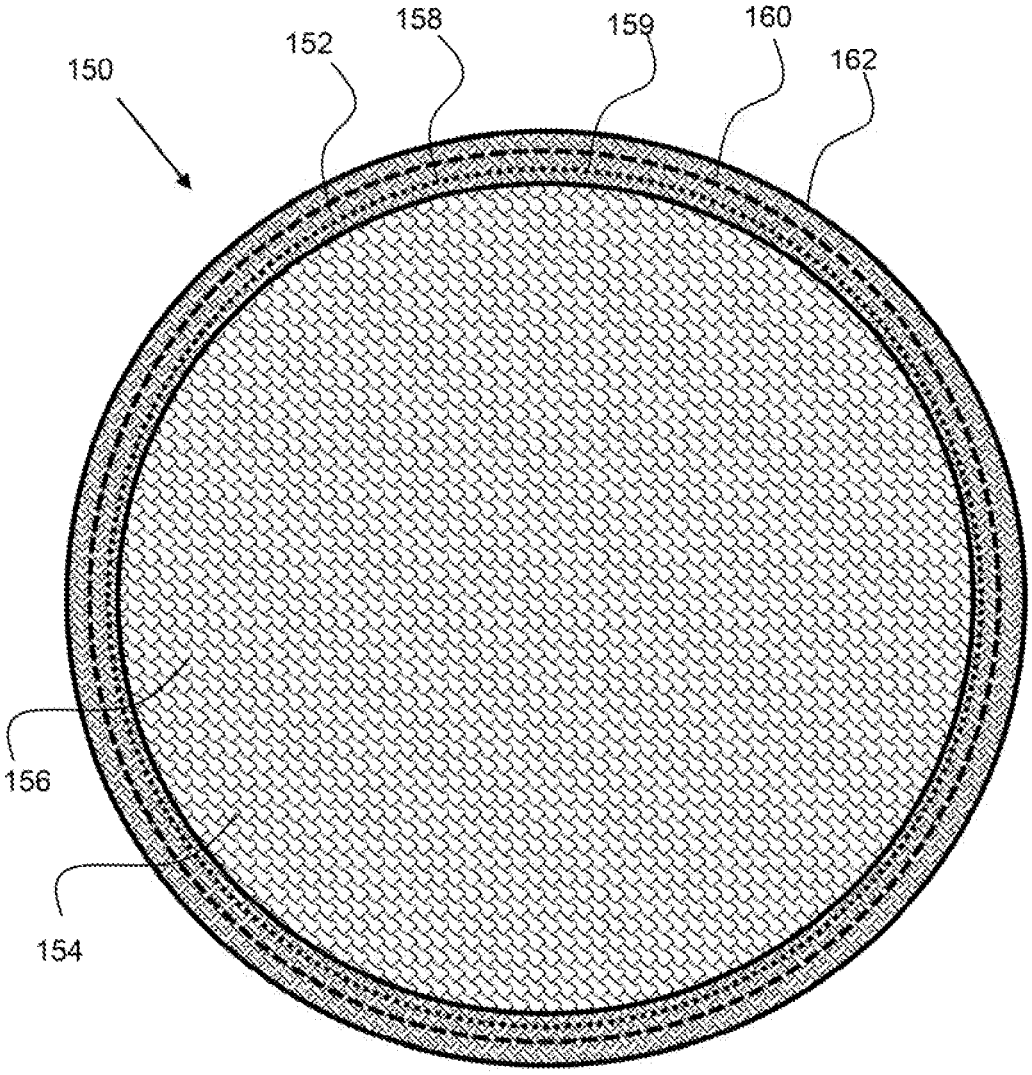
FIG. 19 shows an exemplary insect flying disc device.

As shown in FIG. 19, an exemplary insect flying disc 150 comprises a metal fabric 158 configured in a circular shape with a sleeve 152 extending therearound. The central portion may be a multilayer metal fabric 154 and may be a clear-view area 156, that is highly translucent, as described herein. The sleeve 152 may be a fabric sleeve 158 that extends around the metal fabric and is secured with a stitch 159. A resilient ring 160 such as a spring steel ring 162 may be configured within the sleeve and allow the insect flying disc to be folded to a smaller dimension for storage. The resilient ring will pop open the insect flying disc 150 to the disc shape as shown when released from restrained orientation. The insect flying disc can be thrown to capture insects in the air and may land over insects or other animals to keep them retained under the flying disc.

It will be apparent to those skilled in the art that various modifications, combinations and variations can be made in the present invention without departing from the spirit or scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A cut resistant and highly translucent tote comprising:
a) a multilayer knitted metal fabric comprising:
i) a knitted metal outside layer;
ii) a knitted metal inside layer;
b) a top opening having an opening sleeve that extends over the outside and inside layers of knitted metal;
c) a base,
d) a clear-view portion extending from the opening sleeve to the base that is highly translucent;
e) a front surface;
f) a back surface;
g) a left side;
h) a right side; and
i) a height from the opening to the base along a height axis.

2. The cut resistant and highly translucent tote of claim 1, wherein the multilayer knitted metal fabric consists of a knitted metal inside layer and knitted metal outside layer that are both an interloping knit comprising a loop axis.

3. The cut resistant and highly translucent tote of claim 2, wherein the loop axis of both the knitted metal inside layer and knitted metal outside layer extends along the height of the tote.

4. The cut resistant and highly translucent tote of claim 1, wherein the tote has a perimeter and wherein the clear view portion extends completely around the perimeter of the tote.

5. The cut resistant and highly translucent tote of claim 1, wherein the clear view portion has an open area of at least 50%.

6. The cut resistant and highly translucent tote of claim 1, wherein the multilayer knitted metal fabric is a fabric sleeve; wherein the multilayer knitted metal fabric is continuous around the perimeter.

7. The cut resistant and highly translucent tote of claim 1, wherein the multilayer knitted metal fabric is an independent layered fabric in the clear view portion of the tote, wherein the knitted metal inside layer and knitted metal outside layer are unattached.

8. The cut resistant and highly translucent tote of claim 1, wherein the clear-view portion consists of the knitted metal inside layer and the knitted metal outside layer.

9. The cut resistant and highly translucent tote of claim 1, having a single crimped edge along the left side and a single crimped edge along the right side;
wherein the tote is an envelope shaped tote having the front and back surfaces extending parallel to each.

10. The cut resistant and highly translucent tote of claim 1, having two crimped edges extending along the left side from the base to the top-opening sleeve and two crimped edges extending along the right side from the base to the top-opening sleeve;
wherein the tote is block shaped tote having rectangular front and back surfaces, left and right surface and base.

11. The cut resistant and highly translucent tote of claim 1, comprising a base coupling that extends from the left side to the right side along the base and couples the multilayer knitted metal fabric of the front and back surfaces together.

12. The cut resistant and highly translucent tote of claim 11, wherein the base coupling is an inverted seam wherein the front and back surfaces have a base-crimped edge along the base that extends the front and back surfaces inward toward each other.

13. The cut resistant and highly translucent tote of claim 11, further comprising a base coupling sleeve that extends over the base coupling.

14. The cut resistant and highly translucent tote of claim 1, comprising a gusseted base comprising:
a crimped edge extending between the front surface and gusseted base;
a crimped edge extending between the back surface and gusseted base;
a crimped edge extending between the left side and gusseted base; and
a crimped edge extending between the right side and gusseted base.

15. The cut resistant and highly translucent tote of claim 14, having a single left-side crimped edge extending from the base to the opening sleeve and a single right-side crimped edge extending from the base to the opening sleeve to produce an irregular shaped tote.

16. The cut resistant and highly translucent tote of claim 14, having two left-side crimped edges extending from the base to the opening sleeve to form said left side, and two right-side crimped edges extending from the base to the top-opening sleeve to produce said right side and wherein the tote is a block shaped tote.

17. A cut resistant and highly translucent tote comprising:
a) A multiply knitted metal fabric comprising:
i) a knitted metal outside layer;
ii) a knitted metal inside layer;
wherein the multilayer knitted metal fabric is a fabric sleeve having a perimeter and length between free ends; wherein the multilayer knitted metal fabric is continuous around said perimeter;
b) a top opening having an opening sleeve that extends over the outside and inside layers of knitted metal;
c) a base,
d) a clear-view portion extending from the opening sleeve to the base that is highly translucent having an open area of at least 50%;
wherein the multiply knitted metal fabric is an independent layered fabric metal fabric in the clear view portion, wherein the knitted metal inside layer and knitted metal outside layer are unattached;
e) a front surface;
f) a back surface;
g) a left side comprising a crimped edge between the front and back and extending from the base to the opening sleeve;
h) a right side comprising a crimped edge between the front and back and extending from the base to the opening sleeve;

i) a height from the opening to the base along a height axis.

18. The cut resistant and highly translucent tote of claim 17, wherein the clear-view portion consists of multiply knitted metal fabric.

19. The cut resistant and highly translucent tote of claim 17, comprising a base coupling that extends from the left side to the right side along the base and couples the free ends of the multiply knitted metal fabric together;

wherein the base coupling is an inverted seam wherein the front and back surfaces have a base-crimped edge along the base that extends the free ends of the fabric sleeve inward toward each other.

20. The cut resistant and highly translucent tote of claim 17, comprising a gusseted base comprising:

a crimped edge extending between the front surface and gusseted base;

a crimped edge extending between the back surface and gusseted base;

a crimped edge extending between the left side and gusseted base;

a crimped edge extending between the right side and gusseted base; and a base coupling that extends from the left side to the right side along the base and couples the free ends of the multiply knitted metal fabric together; and wherein the tote has two left-side crimped edges extending from the base to the top-opening sleeve to form said left side, and two right-side crimped edges extending from the base to the top-opening sleeve to produce said right side and wherein the tote is a block shaped tote.

* * * * *